United States Patent [19]

Ward

[11] 4,052,935

[45] Oct. 11, 1977

[54] PRINTING DEVICE

[75] Inventor: John R. Ward, St. Paul, Minn.

[73] Assignee: Minnesota Mining and Manufacturing Company, St. Paul, Minn.

[21] Appl. No.: 630,986

[22] Filed: Nov. 12, 1975

[51] Int. Cl.[2] ..... B44B 5/00

[52] U.S. Cl. ..... 101/11; 101/27

[58] Field of Search ..... 101/9-11, 101/27, 31, 41, 44, DIG. 4, DIG. 13, 292, 316, 332, 336, 301, 324; 226/42-44; 197/6, 170

[56] References Cited

U.S. PATENT DOCUMENTS

| | | | |
|---|---|---|---|
| 2,467,880 | 4/1949 | Brumhill | 197/170 |
| 2,604,387 | 7/1952 | Mintz | 101/11 X |
| 3,366,042 | 1/1968 | Birch | 101/27 |
| 3,384,281 | 5/1968 | Mason | 226/44 X |
| 3,435,760 | 4/1969 | Harrison | 101/27 X |
| 3,726,212 | 4/1973 | Combs | 101/27 X |
| 3,791,293 | 2/1974 | Rastooguyeff et al. | 101/292 X |
| 3,815,494 | 6/1974 | Bahnmuller | 101/27 X |

*Primary Examiner*—Edward M. Coven
*Attorney, Agent, or Firm*—Cruzan Alexander; Donald M. Sell; William L. Huebsch

[57] ABSTRACT

A device for printing a message at predetermined intervals along the backing of pressure sensitive adhesive tape. The device comprises a wheel, a peripheral segment of which contacts and supports the adhesive surface of a length of the tape. Raised arcuately disposed surface portions of a heated printing plate defining the message are moved into engagement with a dye impregnated web positioned against the backing of the length of tape supported on the wheel to sublime the dye and thereby print into the backing of the tape. Between printing operations the wheel is rotated to advance the tape along a path so that a new section of the tape is advanced to the wheel and the newly printed portion of the tape is peeled from the surface of the wheel and fed to a tape applying device.

3 Claims, 4 Drawing Figures

PRINTING DEVICE

BACKGROUND OF THE INVENTION

1. Field of the Invention

This invention relates to devices for printing a message at spaced intervals along the backing of pressure sensitive adhesive tape.

2. Description of the Prior Art

U.S. Patent application Ser. No. 631,183, filed concurrently herewith and which is assigned to the assignee of this application (the disclosure whereof is incorporated herein by reference) discloses an invention known to me before the invention of the printing device disclosed in this application. That application teaches the use of a heat volatizable or sublimable dye to print a message through the backsizing and into the backing of a backsized pressure sensitive adhesive tape. The message is formed by pressing a heated contact surface of a printing plate against a web impregnated with the dye and positioned on the backing of the tape. The contact surface is defined by projecting portions of the printing plate corresponding to the message to be printed so that the dye in the contacted web is selectively volatized or sublimed to form the desired message in the backing of the tape.

The tape must be firmly supported during such a printing process, however, which requirement presents a problem in subsequently advancing the tape, since the tape will normally adhere to the surface on which it is supported.

SUMMARY OF THE INVENTION

The present invention provides a device for printing a predetermined message through the backsizing and into the backing of a backsized pressure sensitive adhesive tape by the aforementioned method, which device solves the problem of releasing the tape from the support and efficiently advancing the tape between printing operations.

The printing device according to the present invention comprises a wheel rotatably mounted on a frame and having a cylindrical periphery adapted for contact by the adhesive surface of the tape, and means adapted for guiding the tape along a tape path including an arcuate segment of the cylindrical periphery of the wheel extending from a first position to a second position relative to the frame. The tape is guided so that the adhesive surface of tape along the path contacts the wheel adjacent the first position and peels away from the wheel adjacent the second position. A dye-web is guided and intermittently moved along a path with a length of the dye-web contacting the backing of the length of tape contacting the arcuate segment of the wheel. The device also includes a printing plate having a concave arcuate contact surface with a radius corresponding to the radius of the wheel's cylindrical periphery. The contact surface is defined by projecting portions of the printing plate providing a message and is heated to a predetermined temperature required to volatize or sublime the dye. The wheel is intermittently rotated to intermittently advance the tape along the path by adhesive contact between the tape and wheel and to provide a dwell period between successive advancements. During each of the dwell periods the printing plate is moved from a release position with the contact surface spaced from the arcuate segment of the wheel (which position afforded movement of the tape and dye-web along their paths) to a printing position with the contact surface of the plate pressed against the length of dye-web contacting the tape to print the message into the tape.

BRIEF DESCRIPTION OF THE DRAWING

The invention will be further described with reference to a preferred embodiment thereof illustrated in the accompanying drawing wherein like numbers refer to like parts in the several views, and wherein.

DESCRIPTION OF THE PREFERRED EMBODIMENT

Figure 1:
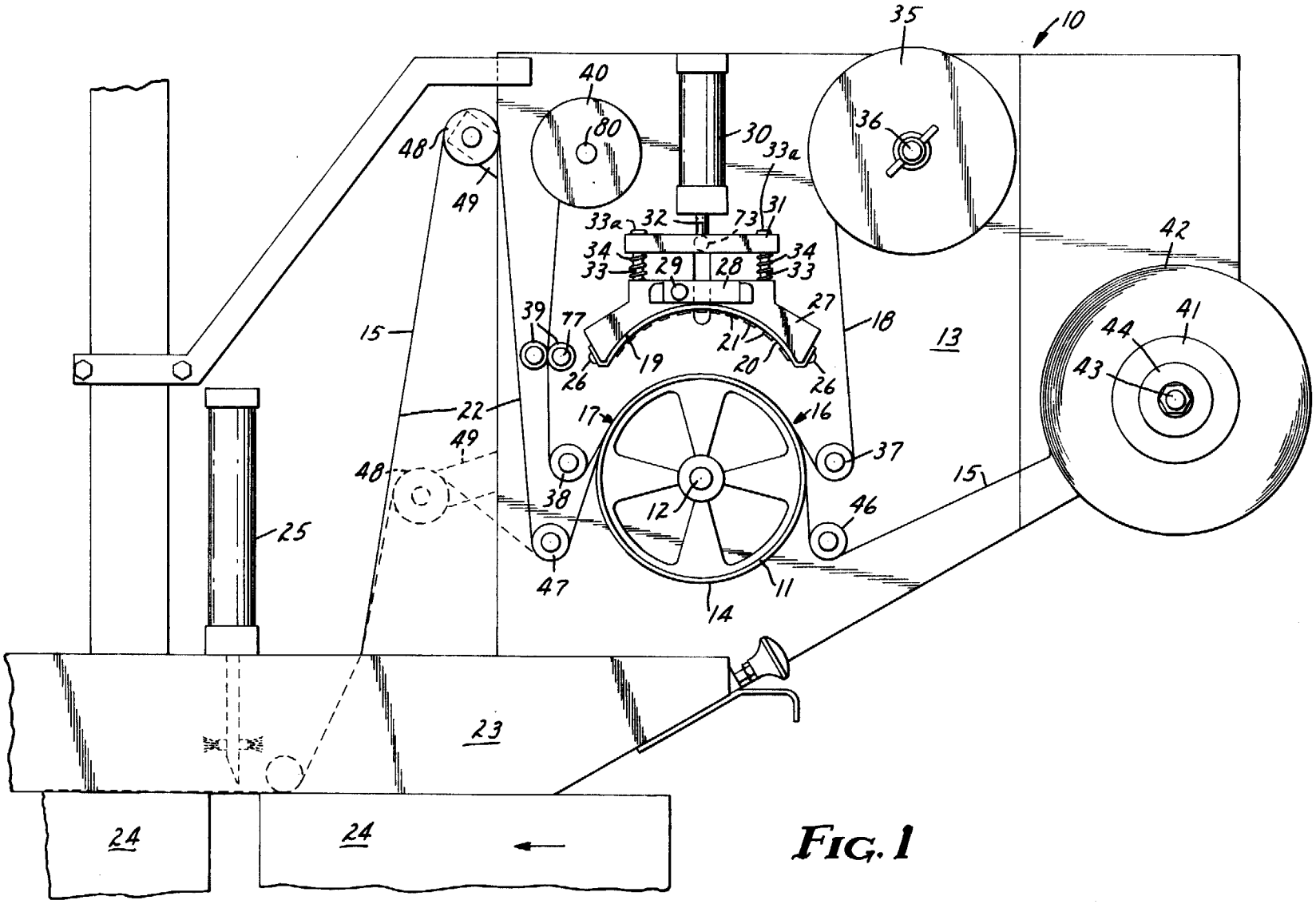
FIG. 1 is a fragmentary vertical front plan view of a printing device according to the present invention mounted adjacent an apparatus for applying lengths of tape to boxes.

Referring now to the drawing there is shown a printing device according to the present invention generally designated by the numeral 10.

Figure 2:
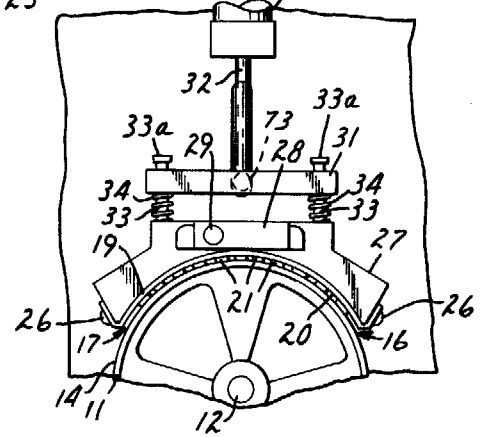
FIG. 2 is a fragmentary view of the device of FIG. 1 but shown with a heated printing plate on the device in a printing position.

As is best seen in FIG. 1, the device 10 includes means for guiding a supply length of backsized pressure sensitive adhesive tape 15 through the device 10 comprising a wheel 11 fixed to a shaft 12 rotatably mounted on a frame 13 for the device 10, which frame 13 comprises two spaced parallel plates. The wheel 11 has an endless cylindrical peripheral support surface 14 defined by an outer layer of resilient material (e.g. silicone rubber) sufficiently wide to support the full width of the pressure sensitive adhesive surface of the tape 15 to be printed, and having surface characteristics adapted to restrict, but not eliminate, adhesion between the tape 15 and the wheel 11. At any rotational position for the wheel 12, the surface 14 has an arcuate segment extending from a first position 16 to a second position 17 relative to the frame 13. The device 10 also includes means for guiding a supply length of a heat volatizable or sublimable dye impregnated web 18 along a dye-web path with a length of the dye-web 18 contacting the backing of the tape 15 between the first and second positions 16 and 17. Means later to be explained are provided for intermittently advancing the tape 15 and the dye-web 18 predetermined distances along their paths through the device 10 to change the portions thereof between the first and second positions 16 and 17, and for providing a dwell period during which the tape 15 and dye-web 18 are stationary between successive advancements. During each dwell period means on the device 10 move a heated metal printing plate 19 from a release position (FIG. 1) to afford movement of the tape 15 and dye-web 18 along their paths, to a printing position (FIG. 2). The printing plate 19 has a curved concave contact surface 20 corresponding in contour to the surface 14 of the wheel 11 and defined by projecting portions 21 of the printing plate 19 (formed as by etching) in the shape of the message. Movement of the printing plate 19 to its printing position presses the contact surface 20 into contact with the dye-web 18 contacting the backing of the tape 15 between the first and second positions 16 and 17 to selectively heat and volatize or sublime the dye therein and print the message into the backing of the tape 15.

As illustrated, the printed portion 22 of the tape 15 is withdrawn from the printing device 10 by a tape applying apparatus 23 which is adapted for taping boxes 24 driven past the apparatus 23 by a conveyor (not shown) and which severs the applied tape from the tape in the apparatus 23 via an air operated knife assembly 25 (e.g. such as the tape applying device designated Model S-609 and available from Minnesota Mining and Manufacturing Company of St. Paul, Minnesota.

The printing plate 19 is removably mounted, as by screws 26 against a metal platen 27 to afford ease in changing printing plates and thereby the message to be printed.

The printing plate 19 is heated by means comprising a thermostatically controlled electrical heater 28 mounted in an opening in the platen 27 extending along the contact surface 20. Preferably the temperature of the heater 28 is adjustable as by a knob 29 to insure proper printing on different types of tape.

The printing plate 19 is mounted on the frame 13 for movement between its release and printing positions by means including an air cylinder 30 mounted on the frame 13 and supporting a support plate 31 at the end of its movable plunger 32. To the side of the platen 27 opposite the printing plate 19 are fixed four parallel spaced outwardly projecting guide pins 33 which are positioned axially parallel with the plunger 32 and are slidably received in the plate 31 from its side opposite the plunger 32. The guide pins 33 have terminal ends 33*a* which limit movement of the platen 27 away from the support plate 31, and four springs 34 positioned between the support plate 31 and the platen 27 bias the platen 27 and support plate 31 away from each other to a position at which the ends 33*a* of guide pins 33 contact the support plate 31. Upon activation the air cylinder 30 will extend its plunger 32 to first engage the contact surface 20 of the printing plate 19 with the length of dye-web 18 between the first and second positions 16 and 17, whereupon the printing plate 19 and platen 27 assembly stop, and to then move the support plate 31 a short distance relative to the platen 27 to slightly compress the springs 34 and insure a uniform predetermined pressure between the contact surface 20 and the lengths of the dye-web 18 and tape 15 on the wheel 11.

In addition to the surface of the tape 15 on the wheel 11 between the first and second positions 16 and 17, the means for defining the path for the dye-web 18 in the device 10 includes a hub 35 rotatably mounted on a shaft 36 fixed to the frame 13. The hub 35 is adapted to receive a roll of the dye-web 18 which roll is retained in a fixed position thereon by a wing nut on the shaft 36 that clamps portions of the hub 35 together. A friction clutch (not shown) is coupled between the hub 35 and shaft 36 to frictionally retard rotation of the hub 35 and provide a slight tension in the dye-web 18 withdrawn from the roll of dye-web 18. From the hub 35 the dye-web 18 extends around a first web guide roller 37, along the surface of the tape 15 on the wheel 11 and around a second web guide roller 38. The web guide rollers 37 and 38 are axially parallel to and flank the wheel 11 in positions so that they guide the dye-web 18 along the surface of the tape between the first and second positions 16 and 17. From the second guide roller 38 the dye-web 18 passes between a pair of nipping rollers 39 spaced to provide driving engagement with the dye-web 18 and provide a portion of means for advancing the dye-web 18 along its path as will later be explained, and to a take-up spool 40.

In addition to the arcuate peripheral portion of the wheel 11 between the first and second positions 16 and 17 the means for defining the tape path includes a tape hub 41 adapted to frictionally engage and support the core of a supply roll 42 of unprinted tape 15. The tape hub 41 is rotatably mounted on a threaded shaft 43 fixed to the frame 13, and a pair of pressure plates 44 fixed to the shaft 42 are biased by a spring 45 so that they press against the sides of the tape hub 41 to restrict its rotation and to provide a tension in the length of the tape 15 threaded through the device 10. From the supply roll 42 the tape 15 extends around a first tape guide roller 46 with its back contacting the roller, along the surface of the wheel between the first and second positions 16 and 17, and around a second tape guide roller 47. The tape guide rollers 46 and 47 flank the wheel 11 on the side of the dye-web guide rollers 37 and 38 opposite the printing plates 19 and guide the tape 15 along the surface of the wheel 11 between the first and second positions 16 and 17, with the second tape guide roller being positioned so that, in conjunction with means for tensioning the printed portion 22 of the tape 15, it provides peeling separation between the adhesive coating on the tape 15 and the surface 14 of the wheel 11 as the tape 15 is driven along its path.

From the second tape guide roller 47 the printed portion of the tape 15 extends in adhesive contact around the knurled peripheral surface of a guide member or guide roller 48 formed of a plastic material which has low adhesion to the tape (e.g. "Delrin"). The guide roller 48 is rotatably attached at the end of an arm 49 pivotably mounted at a pin 50 on the frame 13. The guide roller 48 and the arm 49 provide a portion of the means for tensioning the printed portion 22 of the tape 15 leaving the wheel to insure a clean separation therebetween, and also provide means for deactivating the printing device 10 when the printed portion 22 of the tape 15 reaches a predetermined length and for deactivating the printing cycle when the device 10 cannot supply printed tape at a sufficiently high rate to the tape applying apparatus 23. The arm 49 is biased by a spring 51 to an extended position for the guide roller 48 shown in dark outline in FIG. 1; and is pivotal from its extended position against the bias of the spring 51 toward a retracted position of the guide roller 48 shown in dotted outline in FIG. 1. The length of the path for the printed portion 22 of the tape 15 from the second tape guide roller 47 around the guide roller 48 and to the tape applying apparatus 23 is substantially longer when the guide roller 48 is in its extended position than when it is in its retracted position. When printed tape is used by the tape applying apparatus 23 at a rate faster than it is printed by the device 10, the length of printed portion 22 of the tape 15 will shorten and move the guide roller 48 toward its retracted position. Conversely when the rate of printed tape 22 produced by the printing device 10 exceeds the rate at which tape is used by the apparatus 23 the guide roller 48 will move toward its extended position. A first normally closed microswitch 52 (FIG. 4) is positioned to be contacted by a pin 59 fixed to the arm 49 when the guide roller 48 reaches its extended position and when contacted will deactivate the operating mechanism of the printing device 10 until more tape is used by the tape applying apparatus 23. A second normally closed microswitch 53 is positioned to be contacted by the pin 59 on the arm 49 when the guide roller 48 reaches its retracted position, and when contacted will deactivate the printing cycle of the device 10 and cause the wheel 11 to feed uprinted tape to the tape applying apparatus 23, thereby preventing breakage of the tape 15.

At all positions of the guide roller 48 the spring 51 via the guide roller 48 tensions the printed tape between the wheel 11 and the tape applying apparatus 23 to insure proper peeling separation of the tape from the wheel 11 during advancement of the tape 15 along its path.

Figure 3:
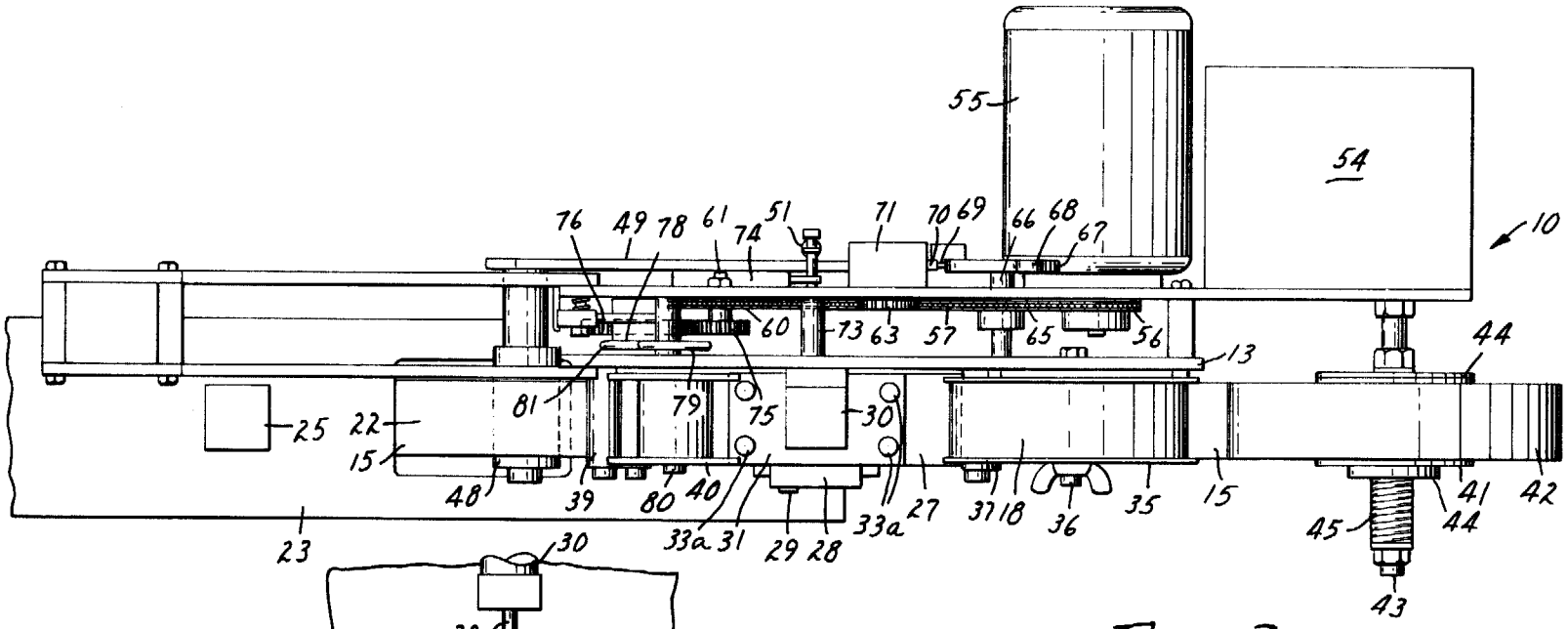
FIG. 3 is a top view of the devices of FIG. 1.
Figure 4:
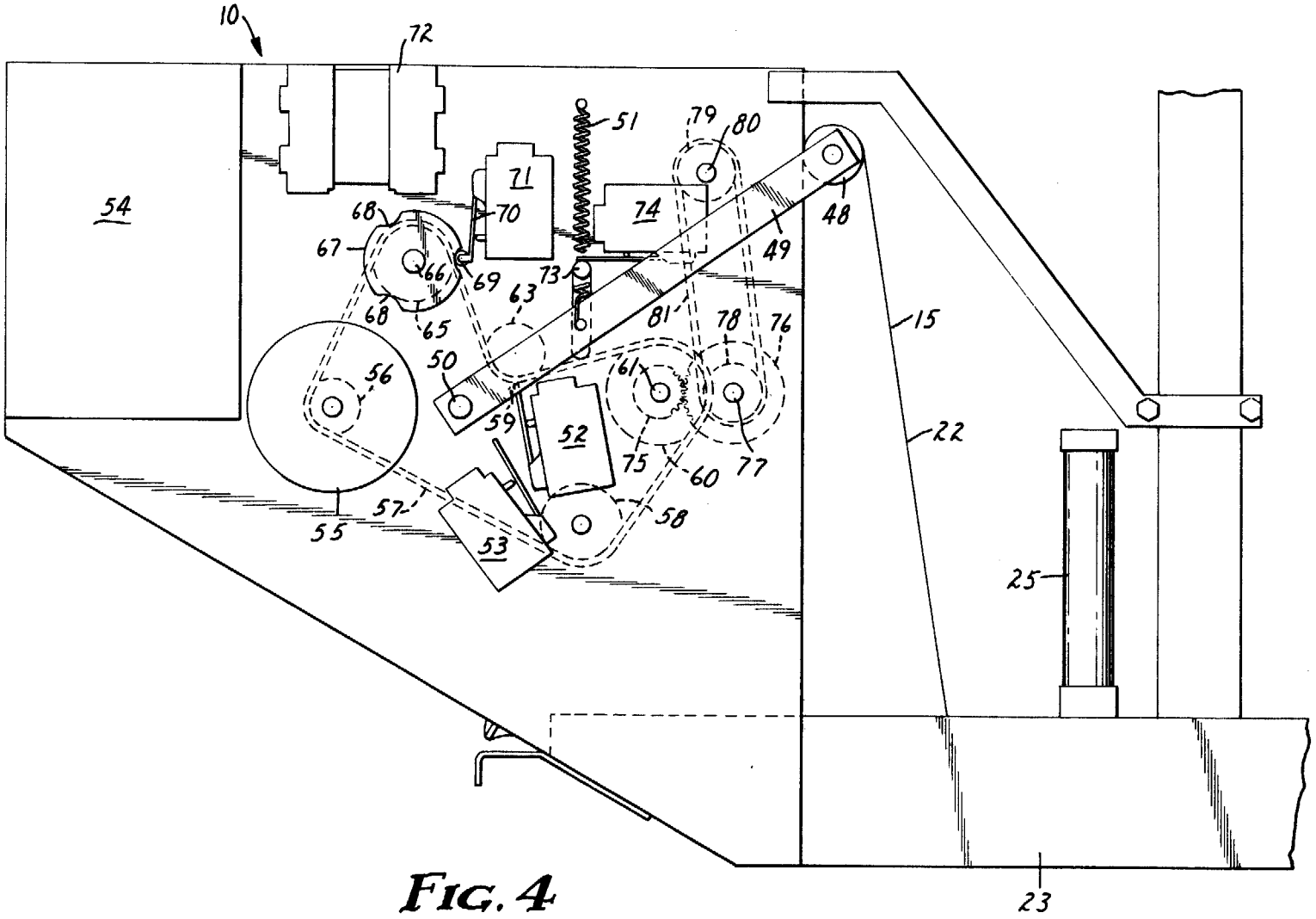
FIG. 4 is a fragmentary vertical back plan view of the devices of FIG. 1.

The drive mechanism and an electrical control system 54 for the device 10, best seen in FIGS. 3 and 4 provides means adapted for intermittently advancing the tape 15 a predetermined distance along the tape path and for providing a dwell period between successive advancements; means for moving the printing plate 19 from its release position to its printing position and back to its release position during each of the dwell periods; and means for advancing the dye-web 18 during each of the advancements of the tape 15 for a distance substantially less than the predetermined distance that the tape 15 is advanced.

A motor 55 carrying a drive sprocket 56 on its rotor shaft is coupled via a drive chain 57 to a sprocket 58 fixed to the shaft 12 to which the wheel 11 is fixed, a sprocket 60 fixed to a shaft 61 rotatably mounted on the frame 13, an idler sprocket 63 and a sprocket 65 fixed to a shaft 66 rotatably mounted on the frame 13 and having a cam wheel 67 fixed at one end. The cam wheel 67 has a peripheral surface which is cylindrical except for three equally spaced detents 68. A follower wheel 69 rotatably mounted on a lever 70 pivoted on a normally open microswitch 71 included in the control system 54 and biased toward the cam wheel 67 rolls along the surface of the cam wheel 67 and will drop into one of the detents 68 to allow the microswitch 71 to interrupt power to the motor 55 when the follower wheel 69 engages one of the detents 68. Upon such an occurrence, the electrical control system 54 actuates a timer (not shown) which, when timed out, again activates the motor 55 to move the follower wheel 69 out of the detent 68, and then drops out of the circuit so that the motor 55 will continue to drive the tape 15 along the tape path by adhesive contact between the tape 15 and the surface 14 of the wheel 11, via the shaft 12, sprocket 58, chain 57 and drive sprocket 56 until the follower wheel 69 engages the next detent 68 and the cycle is repeated. Thus the spacing of the detents 68 determines the distance the tape 15 is advanced between printing operations, and the timer (which is adjustable), determines the duration of the dwell periods.

During each dwell period the control circuit also operates a solenoid 72 which activates the air cylinder 30 to move the printing plate 19 from its release to its printing position for a predetermined time and then returns the printing plate 19 to its release position which is signaled to the control circuit by a rod 73 carried by the plate 31 which contacts a microswitch 74 in the control system 54 when the platen 27 is in its release position.

The means for advancing the dye-web 18 during each of the advancements of the tape 15 comprises a small gear 75 fixed to the shaft 61 and in driving engagement with a larger gear 76 fixed to a shaft 77 rotatably mounted on the frame 13 and to which is fixed one of the nipping rollers 39 which roller 39 has a peripheral surface defined by a layer of resilient material (such as silicone rubber) and is spaced from the other roller 39 to afford driving engagement with the dye-web 18. The shaft 77 also fixedly supports a pulley 78 in driving engagement with a pulley 79 on a shaft 80 fixedly supporting the take-up spool 40 via an endless coil spring 81 which serves as a drive belt while affording slippage so that the take-up spool 40 will wind on the used dye-web 18 while not pulling it from between the nipping rollers 39 which provide the primary means for driving the dye-web 18 along its path. The size ratio between the gears 75 and 76, the sprockets 58 and 60 and the wheel 11 and driving nipping roller 39 provide a significantly lesser amount of advancement for the dye-web 18 than for the tape 15 during each cycle of the machine 10 (e.g. 6 inches for the tape 15 and 0.3 inches for the dye-web 18).

I claim:

1. A device for printing a predetermined message at spaced intervals in the backing of a pressure sensitive adhesive tape by selectively heating portions of a dye-web bearing a heat volatizable or sublimable dye pressed against said backing and adapted for use with a tape applying apparatus which pulls a said tape from the device as the tape is applied, wherein said device comprises:

a frame;

a wheel rotatably mounted on said frame and having a cylindrical periphery adapted for contact by the adhesive surface of a said tape;

means adapted for guiding a said tape along a tape path including an arcuate segment of the cylindrical periphery of said wheel extending from a first position to a second position relative to said frame, said means guiding the tape so that the adhesive surface of the tape is guided into contact with said wheel adjacent said first position and is peeled out of engagement with said wheel adjacent said second position;

means adapted for guiding a said dye-web along a dye-web path with a length of the dye-web contacting the backing of the length of a said tape contacting said arcuate segment of the wheel;

a printing plate having a curved concave contact surface with a radius corresponding to the radius of said cylindrical periphery, said contact surface being defined by projecting portions of said printing plate providing said message;

means for heating the contact surface of said printing plate to a predetermined temperature required to volatize or sublime the dye in a said dye-web;

means mounting said printing plate on said frame for movement for a release position with said contact surface spaced from said arcuate segment of the wheel to afford movement of a said tape and a said dye-web along said paths and a printing position with said contact surface pressed against the length of the dye-web contacting the length of the tape along said arcuate segment of the wheel;

means adapted for intermittently rotating said wheel to intermittently advance a said tape along said path by adhesive contact between the tape and said wheel and to provide a dwell period between successive advancements;

means for moving said printing plate from its release position to its printing position and back to its release position during each of the dwell periods; and means for advancing a said dye-web during each of the advancements of a said tape for a distance substantially less than said predetermined distance;

and wherein said means for guiding said tape further includes an arm supporting a guide member adapted to guide the length of a said tape between a said tape applying apparatus and said second position along said tape path, said arm being mounted on said frame for movement between an extended position for said arm with said guide member positioned to provide a path portion of an extended length between said second position along said tape path and the tape applying apparatus, and a retracted position for said arm with said guide member positioned to provide a path portion of a length substantially shorter than said extended length between said second position along said tape path and the tape applying apparatus, means for biasing the arm toward its extended position; means for deactivating said device when said arm is in its extended position, and means for retaining said printing plate in its release position and for continuously rotating said wheel to advance said tape along said tape path when said arm is in its retracted position while affording operation of said device to print said message at spaced intervals in the backing of said tape when said arm is between its extended and retracted positions.

2. A tape printing device adapted for use with a tape applying apparatus which pulls tape from said device as tape is applied, said device comprising:

a supply length of tape comprising a backing, a layer of pressure sensitive adhesive on one surface of said backing, and a backsizing coating on the surface of said backing opposite said adhesive layer;

a supply length of dye-web comprising an open supporting web bearing a heat volatizable or sublimable dye;

a frame;

a wheel rotatably mounted on said frame and having a cylindrical periphery adapted for contact by the adhesive surface of said tape;

means adapted for guiding said tape along a tape path including an arcuate segment of the cylindrical periphery of said wheel extending from a first position to a second position relative to said frame, said means guiding the tape so that the adhesive surface of the tape is guided into contact with said wheel adjacent said first position and is peeled out of engagement with said wheel adjacent said second position;

means adapted for guiding said dye-web along a dye-web path with a length of the dye-web contacting the backing of the length of said tape contacting said arcuate peripheral segment of the wheel;

a printing plate having a curved concave contact surface with a radius corresponding to the radius of said cylindrical periphery, said contact surface being defined by projecting portions of said printing plate providing a message to be printed;

means for heating the contact surface of said printing plate to a predetermined temperature required to volatize or sublime said dye;

means mounting said printing plate on said frame for movement from a release position with said contact surface spaced from said arcuate peripheral segment of the wheel to afford movement of said tape and said dye-web along said paths and a printing position with said contact surface pressed against the length of the dye-web contacting the length of the tape along said arcuate peripheral segment of the wheel;

means adapted for intermittently rotating said wheel to intermittently advance said tape along said path by adhesive contact between said tape and said wheel and to provide a dwell period between successive advancements;

means for moving said printing plate from its release position to its printing position and back to its release position during each of the dwell periods; and means for advancing said dye-web during each of the advancements of said tape for a distance substantially less than said predetermined distance;

and wherein said means for guiding said tape further includes an arm supporting a guide member adapted to guide the length of said tape between a said tape applying apparatus and said second position along said tape path, said arm being mounted on said frame for movement between an extended position for said arm with said guide member positioned to provide a path portion of an extended length between said second position along said tape path and the tape applying apparatus, and a retracted position for said arm with said guide member positioned to provide a path portion of a length substantially shorter than said extended length between said second position along said tape path and the tape applying apparatus, means for biasing the arm toward its extended position; means for deactivating said device when said arm is in its extended position, and means for retaining said printing plate in its release position and for continuously rotating said wheel to advance said tape along said tape path when said arm is in its retracted position while affording operation of said device to print said message at spaced intervals in the backing of said tape when said arm is between its extended and retracted positions.

3. A tape printing device adapted for use with a tape applying apparatus which pulls printed tape from said device as tape is applied, wherein said printing device includes:

a supply length of tape comprising a backing, a layer of pressure sensitive adhesive on one surface of said backing, and a backsizing coating on the surface of said backing opposite said adhesive layer;

a supply length of dye-web comprising an open supporting web bearing a heat volatizable or sublimable dye;

a frame;

means adapted for guiding said tape along a tape path including support means for supporting a length of the tape from a first position to a second position along said path, said support means comprising a support member having an endless support surface adapted for contact by the adhesive surface of said tape, means mounting said support member on said frame to afford movement of said support surface in an endless track including a track portion extending from said first to said second position, and means for guiding the tape so that the adhesive surface of the tape is guided into contact with said support surface adjacent said first position and peeled out of engagement with said support surface adjacent said second position;

means adapted for guiding said dye-web along a dye-web path through said device with a length of the dye-web contacting the backing of the length of said tape between said first and second positions;

a printing plate having a contact surface corresponding in contour to the support surface between said first and second positions, said contact surface being defined by projecting portions of said printing plate defining a message;

means for heating the contact surface of said printing plate to a predetermined temperature required to volatize said dye;

means mounting said printing plate on said frame for movement from a release position with said contact surface spaced from said support surface to afford movement of said tape and said dye-web along said paths, and a printing position with said contact surface pressed against the length of the dye-web contacting the backing of the portion of the tape along said support surface between said first and second positions;

means adapted for intermittently advancing said tape a predetermined distance along said tape path and for providing a dwell period between successive advancements;

means for moving said printing plate from its release position to its printing position and back to its release position during each of the dwell periods; and means for advancing said dye-web during each of the advancements of said tape for a distance substantially less than said predetermined distance;

and wherein said means for guiding said tape further includes an arm supporting a guide member adapted to guide the length of said tape between a said tape applying apparatus and said second position along said tape path, said arm being mounted on said frame for movement between an extended position for said arm with said guide member positioned to provide a path portion of an extended length between said second position along said tape path and the tape applying apparatus; and a retracted position for said arm with said guide member positioned to provide a path portion of a length substantially shorter than said extended length between said second position along said tape path and the tape applying apparatus, means for biasing the arm toward its extended position; means for deactivating said device when said arm is in its extended position; and means for retaining said printing plate in its release position and for continuously advancing said tape along said tape path when said arm is in its retracted position while affording operation of said device to print said message at spaced intervals in the backing of said tape when said arm is between its extended and retracted positions.

* * * * *